US005899595A

United States Patent [19]

Verlinden et al.

[11] Patent Number: 5,899,595

[45] Date of Patent: May 4, 1999

[54] APPARATUS FOR LIQUID PROCESSING OF PHOTOGRAPHIC SHEET MATERIAL

[75] Inventors: Bartholomeus Verlinden, Tongeren; Patrick Van den Bergen, Hove, both of Belgium

[73] Assignee: Agfa-Gevaert N.V., Mortsel, Belgium

[21] Appl. No.: 08/960,151

[22] Filed: Oct. 29, 1997

[30] Foreign Application Priority Data

Nov. 14, 1996 [EP] European Pat. Off. ..... 96203183

[51] Int. Cl.[6] ..... G03D 3/02

[52] U.S. Cl. ..... 396/626; 396/636

[58] Field of Search ..... 396/612, 617, 396/620, 622, 624, 626, 636, 641, 630

[56] References Cited

U.S. PATENT DOCUMENTS

| | | | |
|---|---|---|---|
| 4,166,689 | 9/1979 | Schausberger et al. | 396/620 |
| 4,687,313 | 8/1987 | Taniguchi et al. | 396/619 |
| 5,541,698 | 7/1996 | Van Den Bergen | 396/626 |
| 5,652,939 | 7/1997 | Verlinden et al. | 396/624 |
| 5,737,662 | 4/1998 | Verlinden et al. | 396/636 |
| 5,754,914 | 5/1998 | Van Den Bergen et al. | 396/612 |
| 5,771,090 | 6/1998 | Verlinden et al. | 396/622 |

*Primary Examiner*—D. Rutledge
*Attorney, Agent, or Firm*—Baker & Botts, L.L.P.

[57] ABSTRACT

The apparatus comprises a housing (10) defining a treatment vessel (12²) having entrance and exit openings (16, 20) defining a sheet material path (22) therethrough. The lower opening (20) is closed by a pair of path-defining rollers (28, 26) biased into contact with each other to form a nip (28) through which the sheet material path (22) extends. The housing (10) includes a collecting chamber (50) positioned to collect treatment liquid which in use falls from the treatment vessel (12²) through one or both of the openings. The collecting chamber (50) is a closed chamber (50) and means (52) are provided to return treatment liquid from the collecting chamber (50) to the treatment vessel (12²). The construction has the advantage that the wastage of treatment liquid is reduced without requiring the use of complicated and costly sealing devices.

9 Claims, 2 Drawing Sheets

APPARATUS FOR LIQUID PROCESSING OF PHOTOGRAPHIC SHEET MATERIAL

FIELD OF THE INVENTION

This invention relates to an apparatus and method for processing photographic sheet material, such as X-ray film, pre-sensitised plates, graphic art film and paper, and offset plates. More particularly the invention relates to improvements in apparatus in which photographic material is transported through one or more treatment units.

BACKGROUND OF INVENTION

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

In a typical apparatus for liquid processing of photographic sheet material, a housing defines a treatment vessel having entrance and exit openings defining a sheet material path therethrough. The housing may include a collecting chamber positioned to collect treatment liquid which in use falls from the treatment vessel through the lower opening or through both of the openings, depending upon the orientation of the apparatus.

Usually, the treatment liquid collected in the collecting chamber is discarded. This is because exposure of the collected liquid to the atmosphere causes oxidation and/or evaporation of the liquid, and renders it less suitable for further use. However, such a practice is wasteful.

Where a vessel opening is closed by a pair of path-defining rollers biased into contact with each other to define a nip through which the sheet material path extends, it has been proposed to incorporate sealing devices between these path-defining rollers and the housing to reduce the quantity of liquid which falls through into the collecting chamber during use. The structure of such sealing devices can be complicated and costly, if the quantity of liquid falling into the collecting chamber is to be significantly reduced. United States patent U.S. Pat. No. 4,166,689 (Schausberger et al. assigned to Agfa-Gevaert AG) describes such an apparatus in which liquid escapes form the lower opening and is intercepted by the tank of a sealing device with two squeegees located in the tank above a horizontal passage in line with the lower opening. One or more pairs of drive rollers in the vessel close the lower opening and also serve to transport the sheet material along a vertical path which extends between the openings of the vessel.

OBJECTS OF INVENTION

It is an object of the present invention to reduce the wastage of treatment liquid without requiring the use of complicated and costly sealing devices.

SUMMARY OF THE INVENTION

We have discovered that this and other useful objectives can be achieved by the use of a closed collecting chamber and by the return of the collected treatment liquid to the treatment vessel.

Thus, according to a first aspect of the invention there is provided an apparatus for liquid processing of photographic sheet material, comprising a housing defining a treatment vessel having entrance and exit openings defining a sheet material path therethrough, the housing including a collecting chamber positioned to collect treatment liquid which in use falls from the treatment vessel through one or both of the openings, characterised in that the collecting chamber is a closed chamber and means are provided to return treatment liquid from the collecting chamber to the treatment vessel.

According to a second aspect of the invention, there is provided a method for the liquid processing of photographic sheet material, comprising passing the sheet material along a sheet material path through a treatment vessel having entrance and exit openings defining the sheet material path, and collecting treatment liquid which falls from the treatment vessel through one or both of the openings in a collecting chamber, characterised in that the collecting chamber is a closed chamber and treatment liquid is returned from the collecting chamber to the treatment vessel.

Although the volume of liquid falling into the collecting chamber may be much less than the volume of liquid in the vessel, so that its surface area is relatively high, the use of a closed collecting chamber means that oxidation and evaporation of this collected liquid is low. By the term "closed" in relation to the collecting chamber we mean that there is substantially no exchange between the collecting chamber and the atmosphere, as is the case with "open" chambers. The "air cushion" above the collected liquid in the collecting chamber will quickly come to equilibrium with the collected liquid following start-up of the apparatus, after which oxidation and evaporation will be reduced to a minimum. The quality of the collected liquid does not therefore differ significantly from the quality of the treatment liquid in the vessel. It is therefore possible to return this liquid to the vessel, without significantly disturbing the treatment process taking place therein. It is possible, though not essential, for the "air cushion" above the collected liquid to be filled with an inert gas, such as nitrogen or carbon dioxide, depending upon the nature of the treatment liquid.

In a usual construction of the apparatus, the vessel opening is closed by a path-defining roller biased into contact with a reaction surface to form a nip through which the sheet material path extends.

The reaction surface towards which the roller is biased to define the nip will usually be the surface of another roller, or for the reaction surface to be in the form of a belt or a fixed surface with a low friction coefficient. Where this general description refers to the use of two rollers, it is to be understood that the second roller may be replaced by any other reaction surface, such as those referred to above.

The path-defining rollers may be driven rollers, thereby constituting transport means for driving the sheet material through the treatment vessel, or they may be freely rotating rollers in which event alternative transport means may be provided. In order to reduce the torque required to rotate the rollers, the ratio of the maximum roller diameter to the length of the nip is preferably greater than 0.012.

Typical rollers have a core provided with a covering of elastomeric material, although it is possible for the roller to be elastomeric throughout its cross-section. As the sheet material leaves a given liquid treatment vessel it is necessary to remove any liquid carried on the sheet material as efficiently as possible, to prevent carryover of liquid into a next treatment vessel and to reduce edge effects which arise from non-homogeneous chemistry on the sheet material after squeegeeing. To do this job properly, the rollers must exert a sufficient and homogeneous pressure over the whole width of the sheet material. Also, to reduce edge effects, it is desirable that the opposite roller surfaces are in contact with each other beyond the edges of the sheet material. To put this problem in context, rollers used in conventional processing apparatus for example have a length of 400 mm or more and a diameter of from 24 to 30 mm. The sheet material typically has a width of from a few millimetres up to 2 m and a thickness of 0.05 mm to 0.5 mm. In view of the nature of elastomeric material, it is in fact impossible to totally eliminate any gap between the roller surfaces at the edges of the sheet material as it passes through the nip. It is desirable that the roller surfaces be in contact with each other within as short a distance as possible from the edges of the sheet material i.e. that the size of the leak zone should be minimised. It is important however that the force between the rollers is sufficient to prevent leakage when no sheet material is passing through. However, the force must not be so high as to risk physical damage to the sheet material as it passes through the nip.

The objective of a minimum leak zone referred to above can be achieved if the ratio of the diameter of the roller to its length is above a critical limit.

To achieve this, at least one of the rollers, and preferably each roller, comprises a rigid core carrying a covering of elastomeric material, the ratio ($\Phi/L$) of the maximum diameter ($\Phi$) of the elastomeric material covering to the length (L) thereof being at least 0.012, most preferably between 0.03 and 0.06. Where the reaction surface towards which the roller is biased to define the nip is the surface of another roller, it is preferred that the roller requirements referred to above apply to this, second, roller also. Indeed, it will be usual for the two rollers to be identical, although it is possible that the diameters ($\Phi$), and therefore the ratios ($\Phi/L$), of the two rollers need not be identical. It is also possible that the reaction surface may be formed by the surface of a second roller which does not conform to the above requirements, such as for example, a roller having no elastomeric covering, or for the reaction surface to be in the form of a belt.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber. The hardness of the elastomeric material may be between 15 Shore (A) and 90 Shore (A), as measured on the roller surface. In one embodiment of the invention, the diameter ($\Phi$) of the elastomeric material covering is constant along the length of the roller. Alternatively the roller may have a radial dimension profile which varies along the length thereof. In the latter case, the diameter ($\Phi$) in the expression $\Phi/L$ is the maximum diameter. In a preferred embodiment, such a roller comprises a non-deformable core, the thickness of the elastomeric material covering varying along the length thereof. Alternatively or additionally, the diameter of the core varies along the length thereof.

Ideally, the radial dimension profile of such a roller is such in relation to the force applied by the roller to sheet material passing through the nip as to be substantially even over the width thereof.

The radial dimension of the roller ideally decreases towards the ends thereof i.e. a convex profile, especially a parabolic profile.

Preferably, the core has a flexural E-modulus of between 50 GPa and 300 GPa. Suitable materials for the rigid core include metals, such as stainless steel, non-ferrous alloys, titanium, aluminium or a composite thereof.

In one embodiment of the invention, the core is hollow. Alternatively the core may be solid.

The rollers may be biased together by a variety of methods. The rollers may be biased together for example by making use of the intrinsic elasticity of the elastomeric material, by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

In a convenient arrangement, the housing further includes a return liquid inlet opening into the vessel and the means to return treatment liquid from the collecting chamber to the vessel comprises a liquid return pipe extending from the collecting chamber to the return liquid inlet. The return liquid inlet may be positioned above the liquid level in the treatment vessel. Otherwise, it may be necessary to prevent liquid from the vessel passing along the pipe to the collecting chamber. Preferably a pump is positioned along the length of the liquid return pipe.

In a preferred embodiment, the vessel is also closed. This ensures that substantially no evaporation and oxidation of the treatment liquid take place in the vessel. Means may be provided to connect the air cushion above treatment liquid in the collecting chamber with the air cushion above liquid in the vessel, such as a passage extending from the collecting chamber to the vessel. Thus as the collected liquid is returned to the vessel, air from the air cushion above the treatment liquid in the vessel replaces it. Thereby no external air is drawn into the apparatus and substantially no suction effect is produced in the collecting chamber which would cause further treatment liquid to fall through the or each opening of the vessel.

In a preferred embodiment, sealing means are provided for sealing the path-defining rollers to the housing, the collecting chamber being positioned below the sealing means. These sealing means may be in the form of stationary sealing members, or rotatable sealing rollers, carried by the housing and positioned in contact with the path-defining rollers.

In a conventional processing apparatus the sheet material is transported along a generally horizontal feed path, the sheet material passing from one vessel to another usually via a circuitous feed path passing under the surface of each treatment liquid and over dividing walls between the vessels. While the present invention is applicable to such an horizontally configured apparatus, it finds its greatest value in vertical processors, i.e. processing machines having a substantially vertical orientation in which a plurality of vessels are mounted one above the other in a stack, each vessel having an opening at the top acting as a sheet material inlet and an opening at the bottom acting as a sheet material outlet or vice versa.

In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus.

In preferred embodiments of the present invention, there are provided means for connecting each vessel to adjacent vessels in the stack in a closed manner. By the term "closed manner" in this specification is meant that each vessel is so connected to adjacent vessels that no vessel is open to the environment. By connecting vessels together in this manner, contrary to the apparatus described in U.S. Pat. No. 4,166,689, the evaporation, oxidation and carbonisation of treatment liquids can be significantly reduced.

The housing wall of each vessel may comprise an upper housing wall part and a lower housing wall part, the upper housing wall part being so shaped in relation to the lower housing wall part of the next higher vessel as to provide a substantially closed connection between adjacent vessels. For example, the upper and lower housing wall parts may be provided with flanges, means being provided to secure the flange of the upper housing wall part with the flange of the lower housing wall part of the next higher vessel thereby to provide the substantially closed connection.

The rollers and associated sealing means of the top-most vessel of the stack serve to provide a gas-tight cover for the apparatus.

The top-most vessel will not normally be a liquid-containing vessel, serving simply as the gas-tight cover for the apparatus.

A lower part of the housing wall of each vessel may be so shaped as to define the collection chamber.

Each vessel may be of modular construction and provided with means to enable the vessel to be mounted directly above or below an identical or similar other vessel. Alternatively, the apparatus may take an integral or semi-integral form in which the means for connecting each vessel to adjacent vessels in the stack in a closed manner is constituted by a common housing wall of the apparatus. By the term "semi-integral form" we intend to include an apparatus which is divided by a substantially vertical plane passing through all the vessels in the apparatus, particularly the plane of the sheet material path, enabling the apparatus to be opened-up for servicing purposes, in particular to enable easy access to the rollers.

The vessel may include guide plates positioned on either side of the sheet material path to divide the vessel into a plurality of regions, including a first region, through which the sheet material path extends, in communication with at least one second region remote from the sheet material path. The housing may include a fresh treatment liquid inlet opening into the vessel to supply fresh treatment liquid to the first region and a used treatment liquid outlet exiting from the vessel to remove used treatment liquid from the at least one second region. The fresh treatment liquid inlet and the used treatment liquid outlet can thereby be conveniently positioned on the same side of the apparatus.

One or more of the vessels of the apparatus may include additional features if desired. Cleaning means may be provided for acting upon the rollers to remove debris therefrom, as described in European patent application EP 93202862 (Agfa-Gevaert NV), filed Oct. 11, 1993. Additional rollers, such as a roller pair or staggered rollers may be provided for transporting the sheet material through the apparatus, and these rollers will normally be driven rollers. Additional roller pairs may be provided for breaking the laminar fluid at the surface of the sheet material as it passes through the apparatus, and these rollers may be driven rollers or freely rotating rollers. Even when additional roller pairs are present, the rollers to which the (Φ/L) criterium applies and their associated sealing means will usually constitute the lower roller pair, serving to close the lower opening of the vessel. Spray means may be provided for applying treatment liquid to the sheet material. Guide means may be included for guiding the passage of the sheet material through the apparatus. Heating means may be provided in one or more vessels so that the vessel becomes a sheet material drying unit, rather than a wet treatment unit. While liquid pumping, heating, cooling and filtering facilities will normally be provided outside the vessels, it is possible for some elements of these features to be included in the vessels themselves. Any combination of these additional features is also possible.

DETAILED DESCRIPTION OF THE INVENTION

Figure 1:
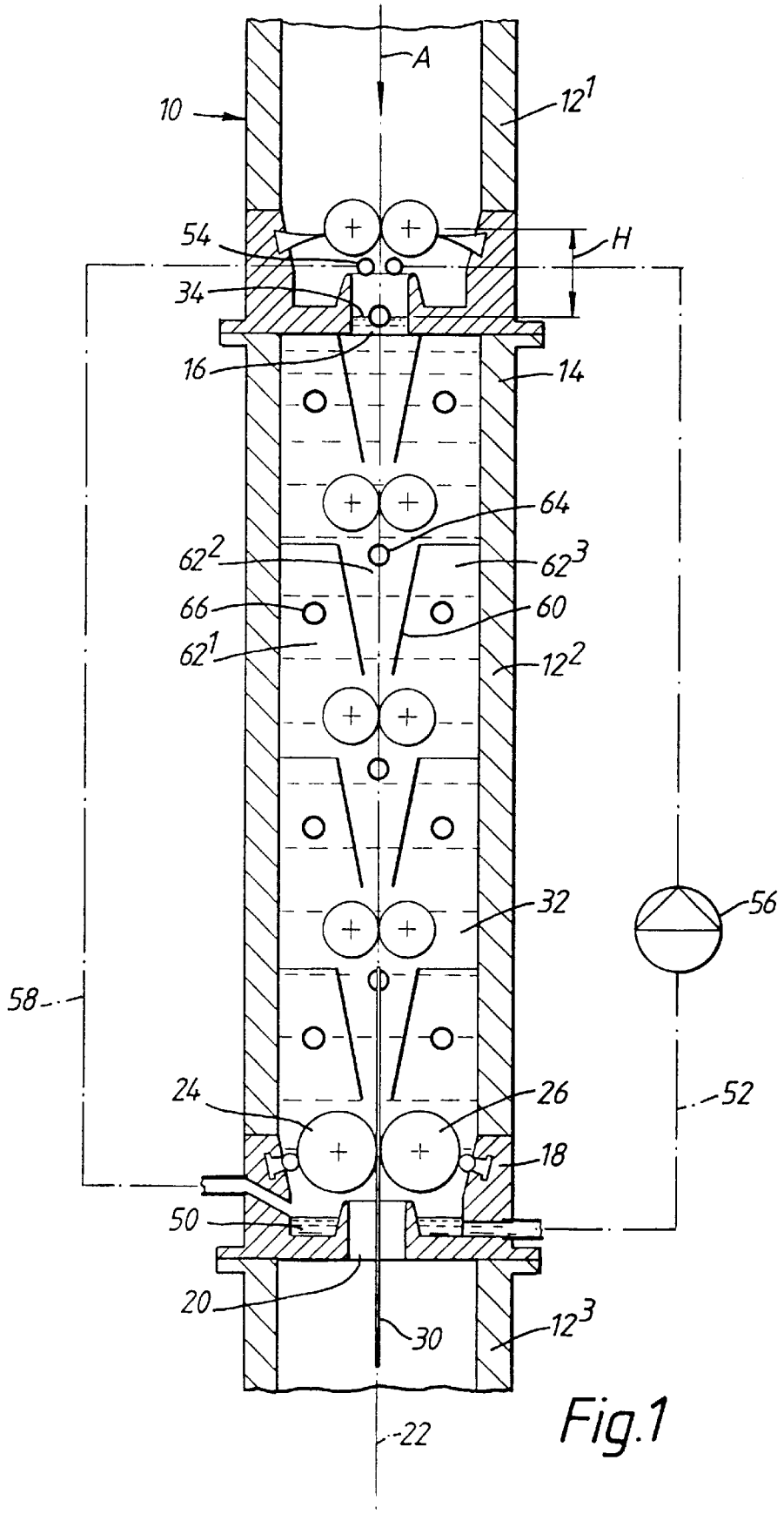
Figure 2:
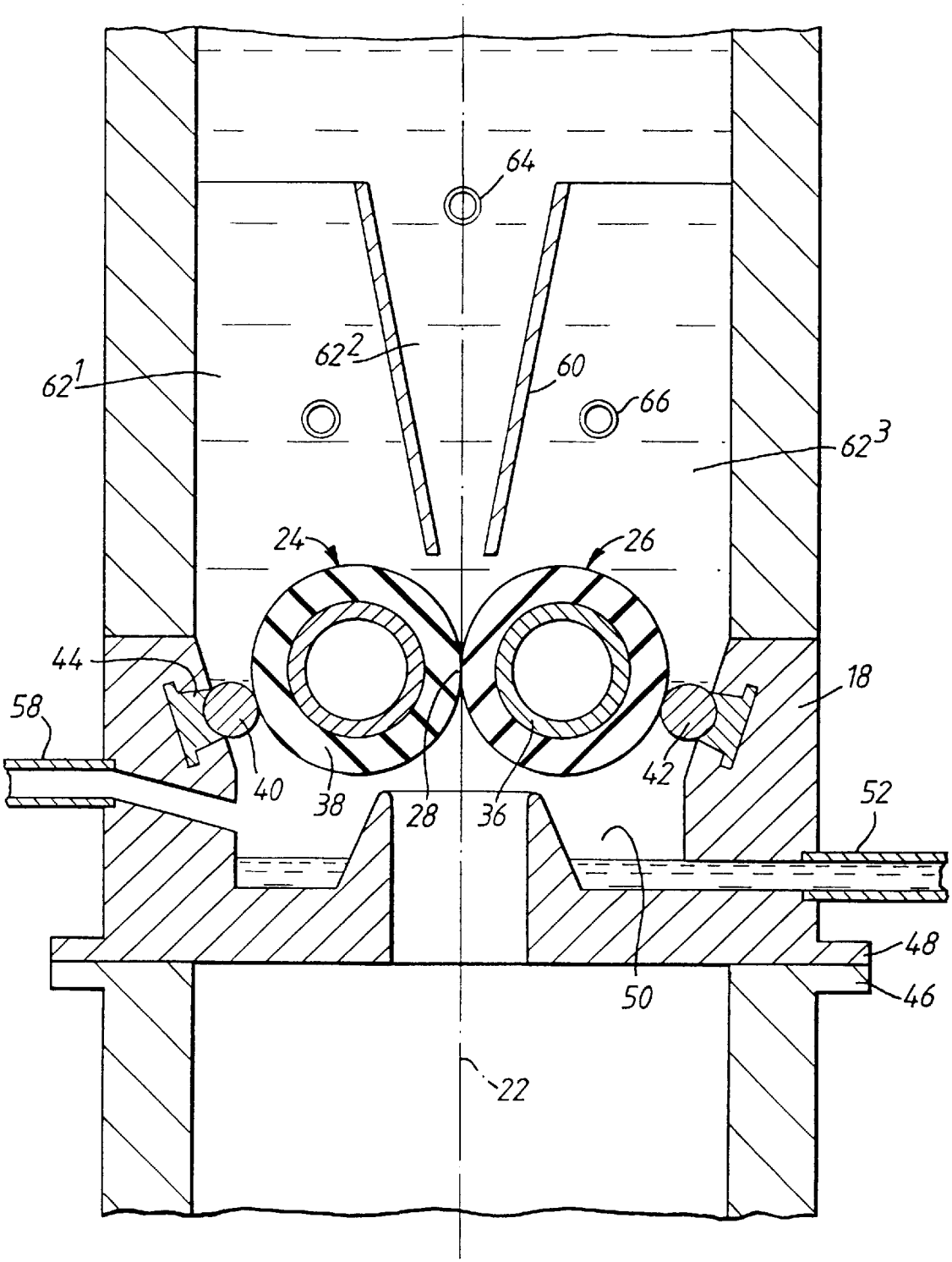

The invention will be described by the following illustrative embodiments with reference to the accompanying drawings without the intention to limit the invention thereto, and in which:

FIG. 1 is a cross-section of part of a vertical processing apparatus according to the invention; and FIG. 2 is an enlarged view of part of FIG. 1.

Although only one specific embodiment of an apparatus according to the invention is shown in the Figures, the invention is not restricted thereto. The apparatus for the wet processing of photographic sheet material such as X-ray film. These vessels may be arranged to provide a sequence of steps in the processing of sheet photographic material, such as developing, fixing, rinsing and drying. The vessels may be of a modular structure as shown or may be part of an integral apparatus.

An apparatus for liquid processing of photographic sheet materials is shown in the Figures. The apparatus comprises a housing 10 defining a plurality of the vessels $\mathbf{12}^1$, $\mathbf{12}^2$, $\mathbf{12}^3$ are arranged one above another in a stack, one vessel $\mathbf{12}^2$ being shown in full.

The vessel $\mathbf{12}^2$ which is of generally rectangular cross-section comprises a housing defined by a housing wall so shaped as to provide an upper part 14 having an upper opening 16 and a lower part 18 having a lower opening 20, the sheet material 30 moving in a downwards direction as indicated by the arrow A. The vessel $\mathbf{12}^2$ is closed from the atmosphere. Upper entrance and lower exit openings 16, 20 define a sheet material path 22 through the vessel $\mathbf{12}^2$. The lower exit opening 20 is closed by a pair of path-defining rollers 24, 26 biased into contact with each other to form a nip 28 through which the substantially vertical sheet material path 22 extends. The vessel $\mathbf{12}^2$ contains treatment liquid 32. The distance H between the surface 34 of the liquid 32 and the nip of the rollers of the next upper vessel $\mathbf{12}^1$ is as low as possible.

Each path-defining roller 24, 26 is of the squeegee type comprising a stainless steel hollow core 36 carrying an elastomeric covering 38. The core 36 is in cylindrical form having constant internal and external diameters along the length thereof. The path-defining rollers 24, 26 are biased towards each other with a force sufficient to effect a liquid tight seal but without causing damage to the photographic sheet material 30 as it passes there-between. The line of contact between the path-defining roller surfaces defines the nip 28. The sheet material preferably has a width which is at least 10 mm smaller than the length of the nip, so as to enable a spacing of at least 5 mm between the edges of the sheet and the adjacent limit of the nip 28, thereby to minimise leakage. The path-defining rollers 24, 26 are coupled to drive means (not shown) so as to constitute drive path-defining rollers for driving the sheet material 30 along the sheet material path 22.

Sealing means are provided for sealing the path-defining rollers 24, 26 to the housing 10. Each path-defining roller 24, 26 is in sealing contact along its length, with a respective rotatable sealing roller 40,42 carried on a sealing support 44, which in turn is secured to the wall of the vessel 12, the sealing rollers 40, 42 serving to provide a gas- and liquid-tight seal between the path-defining rollers 24, 26 on the one hand and the housing wall on the other. The treatment liquid 32 is therefore retained in the vessel 12 by the path-defining rollers 24, 26 and the sealing rollers 40, 42. The sealing rollers 40, 42 are formed of hardened or PTFE coated metal.

The upper and lower housing wall parts 14, 18 are provided with flanges 46, 48 respectively provided with bolts (not shown) to enable the vessel $12^2$ to be mounted directly above or below an identical or similar other vessel $12^1$, $12^3$, as partly indicated FIG. 1. In the illustrated embodiment, the adjacent vessels $12^1$ and $12^3$ are non-liquid containing vessels. At least the adjacent vessel $12^3$ is preferably a closed cell. The upper housing wall part 14 is so shaped in relation to the lower housing wall part 18 as to provide a substantially closed connection between adjacent vessels. Thus, treatment liquid from vessel $12^2$ is prevented from falling into the lower vessel $12^3$ by the path-defining rollers 24, 26 and sealing rollers 40, 42, while vapours from the lower vessel $12^3$ are prevented from entering the vessel $12^2$ or escaping into the environment. This construction has the advantage that the treatment liquid in the vessel $12^2$ is not contaminated by contents of the adjacent vessels and that by virtue of the treatment liquids being in a closed system evaporation, oxidation and carbonisation thereof is significantly reduced (and any other undesirable exchange between the treatment liquid and the environment).

The lower part 18 of the housing wall 14 is so shaped as to define a collecting chamber 50. Any treatment liquid which may escape between the path-defining rollers 24, 26 and the associated sealing rollers 40, 42, or even through the nip 28, in particular as the sheet material 30 passes therethrough, drips from the path-defining rollers and falls into the collecting chamber 50. For this reason, the collecting chamber 50 is positioned below the sealing rollers 40, 42. The collecting chamber 50 is closed from the atmosphere. A liquid return pipe 52 extends from the collecting chamber 50 to a return liquid inlet 54 opening into the vessel $12^2$ and serves to return treatment liquid from the collecting chamber 50 to the vessel $12^2$. A pump 56 is positioned along the length of the liquid return pipe 52.

A passage 58 extends from the collecting chamber 50 to the vessel $12^2$ serves to connect the air cushion above treatment liquid in the collecting chamber 50 with the air cushion above liquid in the vessel $12^2$.

The vessel $12^2$ includes guide plates 60 positioned on either side of the sheet material path 22 which divide the vessel $12^2$ into three regions $62^1$, $62^2$, $62^3$, including an inner region $62^2$ through which the sheet material path 22 extends. The guide plates do not extend as far as the end walls of the housing, but are spaced therefrom outside the width of the sheet material, enabling the inner region $62^2$ to be in communication with two outer regions $62^1$, $62^3$ remote from the sheet material path 22. A fresh treatment liquid inlet 64 opens through the far end wall of the housing, as viewed in the figures, into the vessel $12^2$ to supply fresh treatment liquid to the inner region. Re-circulating treatment liquid outlets 66 exit through the same far end wall of the housing from the vessel $12^2$ to remove used treatment liquid from the outer regions $62^1$, $62^3$. The fresh treatment liquid inlet 64 and the recirculating treatment liquid outlet 66 are thereby conveniently positioned on the same side of the apparatus. It is possible to reverse the functions of the inlets and outlets, so that treatment liquid is supplied through inlets 66 and recirculating liquid is removed through outlet 64.

We claim:

1. An apparatus for liquid processing of photographic sheet material, comprising:

a housing defining a closed treatment vessel having entrance and exit openings defining a sheet material path therethrough;

treatment liquid in said closed treatment vessel;

a gas cushion in said housing above the treatment liquid in said closed treatment vessel;

a closed collecting chamber in said housing positioned below said closed treatment vessel to collect treatment liquid which in use falls from said treatment vessel through said exit opening;

a gas cushion in said closed collecting chamber above the treatment liquid collected therein;

a return liquid inlet opening into said closed treatment vessel;

a liquid return pipe extending from said closed collecting chamber to said return liquid inlet opening to return treatment liquid from said closed collecting chamber to said closed treatment vessel; and a passage extending from said closed collecting chamber to said closed treatment vessel to connect said gas cushion above the treatment liquid in said closed collecting chamber with said gas cushion above the treatment liquid in said closed treatment vessel.

2. An apparatus according to claim 1, wherein a pump is positioned along the length of said liquid return pipe.

3. An apparatus according to claim 1, wherein said exit opening is closed by a pair of path-defining rollers biased into contact with each other to form a nip through which said sheet material path extends, and further comprising sealing means for sealing said path-defining rollers to said housing, said collecting chamber being positioned below said sealing means.

4. An apparatus according to claim 1, wherein a plurality of said treatment vessels are mounted one above another in a stack.

5. An apparatus according to claim 1, wherein said closed treatment vessel includes guide plates positioned on either side of said sheet material path to divide said closed treatment vessel into a plurality of regions, including a first region through which said sheet material path extends in communication with at least one second region spaced from said sheet material path.

6. An apparatus according to claim 5, wherein said housing includes a fresh treatment liquid inlet opening into said treatment vessel to supply fresh treatment liquid to said first region and a used treatment liquid outlet exiting from said closed treatment vessel to remove used treatment liquid from said at least one second region.

7. An apparatus according to claim 6, wherein said fresh treatment liquid inlet and said used treatment liquid outlet are positioned on the same side of the apparatus.

8. An apparatus according to claim 6 wherein said gas cushion is an inert gas.

9. A method for the liquid processing of photographic sheet material, comprising passing said sheet material along a sheet material path through a closed treatment vessel having entrance and exit openings defining said sheet material path, collecting treatment liquid which falls from said treatment vessel through said exit opening in a closed collecting chamber, returning treatment liquid from said closed collecting chamber to said treatment vessel along a liquid return pipe extending from said closed collecting chamber to a return liquid inlet opening into said closed treatment vessel; and connecting a gas cushion above the treatment liquid in said closed collecting chamber with a gas cushion above the treatment liquid in said closed treatment vessel by way of a passage extending from said closed collecting chamber to said closed treatment vessel.

* * * * *